US005538192A

United States Patent [19]

Parham

[11] Patent Number: 5,538,192

[45] Date of Patent: Jul. 23, 1996

[54] PLUNGER CAN AND SPRING COMPRESSOR

[76] Inventor: Robert L. Parham, 1675 Larimer Ste. 425, Denver, Colo. 80202

[21] Appl. No.: 291,430

[22] Filed: Aug. 16, 1994

[51] Int. Cl.[6] ..... B02C 15/04

[52] U.S. Cl. ..... 241/30; 241/121; 241/289

[58] Field of Search ..... 241/117, 121, 241/30, 288, 289

[56] References Cited

U.S. PATENT DOCUMENTS

| | | | |
|---|---|---|---|
| 3,881,348 | 5/1975 | Morton | 241/121 X |
| 4,538,768 | 9/1985 | Paskowski, Jr. et al. | 241/101.2 |
| 4,706,900 | 11/1987 | Prairie et al. | 241/121 |
| 4,717,082 | 1/1988 | Guido et al. | 241/121 |
| 4,759,509 | 7/1988 | Prairie | 241/121 |
| 5,242,123 | 9/1993 | Parham | 241/37.5 |

*Primary Examiner*—John Husar
*Attorney, Agent, or Firm*—Davis, Graham & Stubbs

[57] ABSTRACT

A plunger can structure and a mated spring compressor system. The plunger can includes a plunger tip and an indicator rod extending from the plunger tip through the plunger can and out the opposite end of the plunger can. Removal and replacement of a shim between the plunger tip and the roller assembly which adjust the force on the roller assembly, can be easily accomplished without opening the clamshell doors to the mill by drawing the indicator rod out of the opposite end of the plunger can to effect a drawing in of the plunger tip.

2 Claims, 3 Drawing Sheets

PLUNGER CAN AND SPRING COMPRESSOR

BACKGROUND OF THE INVENTION

This invention pertains to coal pulverizing mills, and more particularly to the plunger can structures which contain mechanical spring suspension systems used in such mills.

Pulverizing mills are used to pulverize coal, limestone and other solid materials. In the case of coal, gravel sized coal enters the mill and is pulverized into a powder. The powder is carried out of the pulverizer by a high velocity air stream and into a furnace where it explosively burns to heat steam which, in an electrical power generator, drives a turbine to generate electricity. The pulverizers are designed to operate continuously, except during periods of repair. Examples of these kinds of coal pulverizers are in U.S. Pat. Nos. 4,705,223 by Dibowski et al.; 4,694,994 by Henne et al.; 4,679,739 by Hashimoto et al.; 4,522,343 by Williams; 4,491,280 by Bacharach; and 4,717,082 by Guido et al.

The pulverizing is accomplished by directing the coal onto grinding tables which interface with pulverizing rollers. The rollers are each mounted on a separate roller assembly shaft, and each roller assembly shaft is mounted on a clamshell door in the pulverizer. Typically, the grinding table is a disk-shaped member with an annular groove or raised circumferential edge in the top surface. The grinding table rotates so that the annular groove mates with the rollers. The coal is introduced from the top of the assembly and feeds by gravity to the annular groove where it is pulverized as the grinding table rotates under the rollers. The pulverized coal dust is discharged from the grinding table by a high velocity air flow deflected over the grinding table. The coal dust is redirected through and out of the pulverizing mill by subsequent deflection of the combined flow of air and suspended coal dust particles.

The pulverizing mill may use a rotating grinding table with stationary roller assemblies, as described in U.S. Pat. No. 4,717,082 by Guido et al. (the contents of which are hereby incorporated by reference), and additional examples of these kinds of roller assemblies are in U.S. patent application Nos. 07/464,870 filed Jan. 16, 1990 now U.S. Pat. No. 4,996,757 by Parham and Ser. No. 07/539,574 filed Jun. 18, 1990, now U.S. Pat. No. 5,050,810 by Parharm. Alternatively, the pulverizing mill may use a stationary grinding table and several rotating roller assemblies. The roller assemblies may also be independently biased against the grinding table so that vibration and shock on one roller will not be transferred to all the other rollers, as described in the Guido patent. The rollers and grinding table are massive; each roller weighs several tons and is on the order of five feet in diameter.

The roller assemblies are biased towards the grinding table by means of compression spring assemblies. Because of the large size of present pulverizing mills and grinding rollers, compression spring assemblies exerting forces within the range of 25,000 to 30,000 PSI are common. Those compression spring assemblies typically are housed in a plunger can structure (sometimes referred to in the art also as a "Journal Spring Housing" or "Spring Housing" as a constituent part of a "Mechanical Spring System") which is suitably mounted so as to cooperate with the roller assembly. A typical plunger can structure houses several elements, including a compression spring assembly, a plunger assembly which transfers the force generated by the compression spring to the roller element of the roller assembly, and a plunger bearing assembly, all of which are well known in the art (the plunger assembly is sometimes referred to in the art as a "Stud Assembly" or "Preload Stud Assembly"). Examples of these kinds of plunger can structures and the assemblies housed therein are in U.S. Pat. Nos. 3,881,348 by Morton, 4,706,900 by Prairie, et al. and 4,759,509 by Prairie.

The plunger can structure itself as well as the compression spring assembly, the plunger assembly, the plunger bearing assembly, and all of the interfacing and other elements of each assembly contained within the plunger can are exposed to extreme conditions. The massive roller assemblies with which they cooperate typically revolve at 200 to 300 revolutions per minute. The pulverizing mills within which many of the plunger cans are installed operate at a temperature around 600 to 700 degrees F. In addition, the mills occasionally catch fire. Such fires are frequently smothered with steam and then cooled, resulting in large and fast temperature changes in the pulverizing mills. There is also the constant presence of pulverized coal dust particles throughout the pulverizing mills. Carried by high speed air flow, the coal particles in motion create the effect of a continuous sand-blasting on all component structures within the interior of the pulverizing mill.

The existing multi-part fabricated can, cooperating with its several multi-part assemblies and interfacing elements under the extreme conditions of the pulverizing mill, is a source of a number of costly problems. These problems affect both the fabricated plunger can structure and the assemblies it houses. One problem is that the fabricated plunger can wears out or one or more of the multiplicity of parts comprising it wears out. Such wear in the fabricated plunger can is a product of vibration, abrasion and shock, and is accentuated by differential shrinkage and expansion of its various elements in reaction to heating and cooling in the pulverizing mill. Stress cracks and fractures are not uncommon in the fabricated plunger can structure. So also, and by similar causes, the compression spring assembly, plunger assembly, plunger bearing assembly and interfacing elements contained within the fabricated plunger can structure experience structural degradation, deterioration, misalignment and wear. Other degradation to the assemblies is caused by the cumulative blasting effect, deposit over time, and consequent caking of, coal dust particles around the elements of such assemblies.

Repairing the existing fabricated plunger can structures themselves, and opening them so as to inspect, clean, adjust, or repair or replace the compression spring assembly, plunger assembly, plunger bearing assembly and interfacing elements contained within them presents other difficulties. The compression spring in the plunger can may be under twenty thousand pounds or more of pressure, so that the top tends to explode off the can like a bomb when it is removed, thereby endangering the workmen and surroundings. Also, the existing fabricated plunger can structures must be removed from the pulverizing mill for opening off site. This requires labor and takes time. The pulverizing mill cannot operate during that time, and the down time imposes a cost of many thousands of dollars per day. Electric utilities seek to pass that cost on to rate payers or else absorb it so as to suffer diminished rates of return to their shareholders. An improved plunger can assembly addressing these concerns is described in U.S. Pat. No. 5,242,123 by Parham.

Moreover, wear and degradation to the plunger can structure and to the assemblies housed within it adversely affect the massive roller assemblies of the pulverizing mill. In particular, the wear rate of the roller assemblies is sensitive, not only to the depth, hardness and uniform size and consistency of the coal, but also to the amount and uniformity of the countervailing force applied to the rollers by the compression spring and other assemblies housed within the plunger can structure. The cost of repairing or replacing the rollers is very high in relation to the cost of repairing or replacing the plunger can structures and any of the assemblies contained therein.

One particularly formidable problem presented by plunger cans relates to the interface between the plunger can and the roller assemblies. In the prior art, the plunger tip rides on the roller assembly to provide a biasing force urging the roller assembly down onto the grinding wheel to grind the coal. As the rollers wear, however, more play is introduced into the system which allows the plunger tip to move out of the plunger can to thereby expand the compression spring. Because the force exerted by the compression spring against the plunger tip, and consequently by the plunger tip against the roller assembly, is proportion to the spring compression, this expansion of the compression spring reduces this force. As the roller wear continues, the force reduction becomes unacceptable. At that point, it is necessary to shim between the plunger tip and the roller assembly to take up the play resulting from the roller wear to bring the force exerted by the plunger tip on the roller assembly back up to desired tolerances.

This shimming operation is time consuming, which results in high labor costs and expensive mill down-time. It is generally necessary to open the clamshell doors to the mill on which the plunger assembly is mounted, apply the necessary shims, and then close the clamshell doors. The opening and closing of the clamshell doors is an elaborate procedure.

Another difficulty with the prior art plunger assemblies relates to the configuration of the plunger shaft. It has generally been thought that the plunger shaft should extend from the plunger tip, through the length of the plunger can, and out a bushing on the end of the plunger can opposite the plunger tip, in order to impart longitudinal stability to the reciprocating plunger tip and prevent undue cocking of the plunger tip. However, such a configuration results in an expensive plunger shaft and an expensive bushing to contain the plunger shaft at the end of the plunger can opposite the plunger tip, and high wear on both.

SUMMARY OF THE INVENTION

The present invention is a plunger can structure and mated spring compressor system. The plunger can structure uses fewer parts and an improved plunger shaft as compared to prior art systems. As a result, the plunger can is much easier to service and adjust, thereby increasing the life of the plunger can and decreasing its associated maintenance costs. The preferred embodiment utilizes no plunger shaft extending the entire length of the plunger can, but instead employs a novel plunger tip configuration which mates with the compression spring to distribute the compression-spring force uniformly onto the plunger tip. Also, the plunger tip can be withdrawn into the plunger can for servicing and shimming without opening the clamshell doors or otherwise disassembling the mechanism.

DETAILED DESCRIPTION OF THE PREFERRED EMBODIMENT

Figure 1:
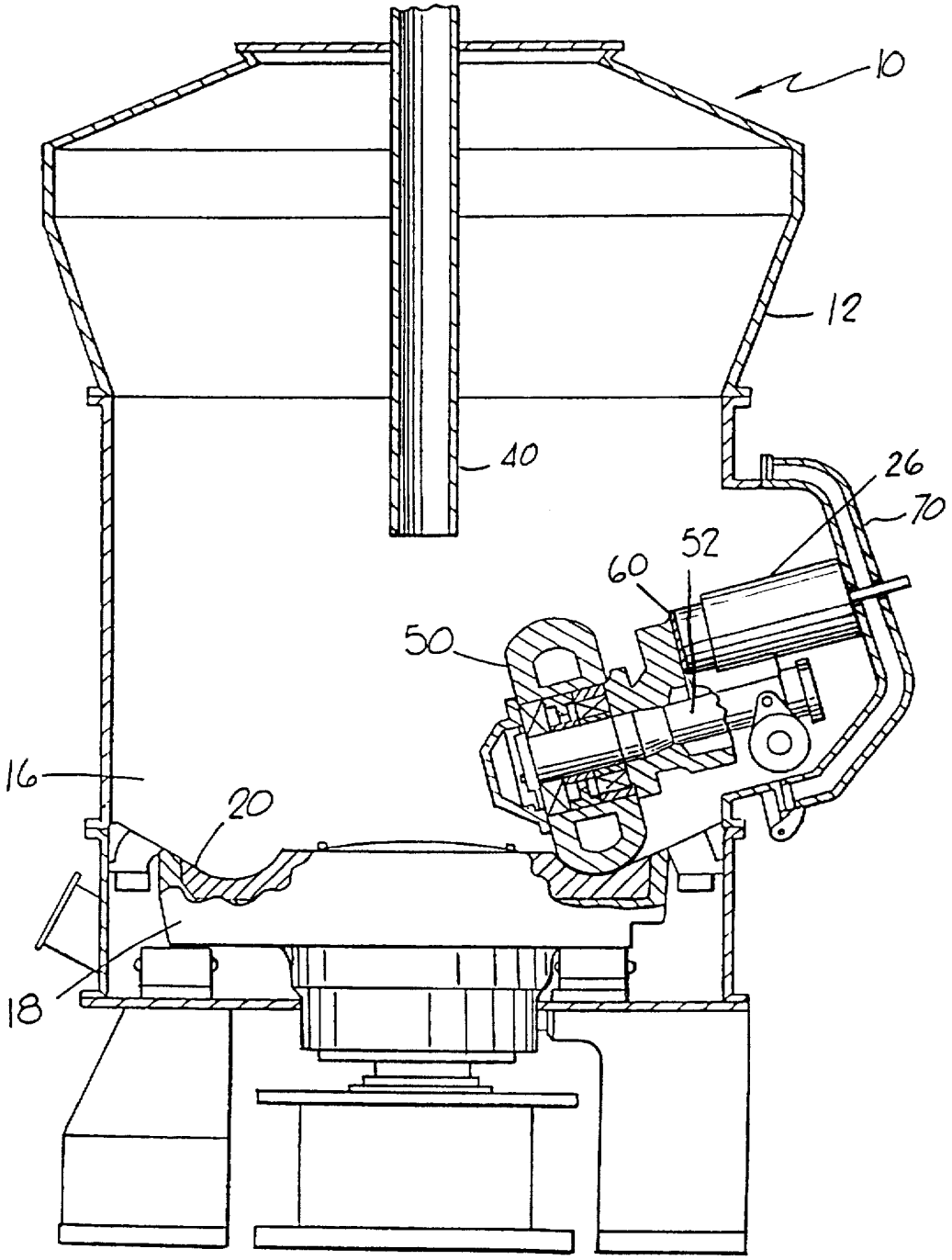
FIG. 1 shows a side view, partially in section, of a typical pulverizer mill in which the present invention may be used.

FIG. 1 shows a typical coal pulverizer mill 10 which is well known in the art. The pulverizer 10 has an outer housing 12 including an upper portion and a lower pulverizing area 16. In the lower pulverizing area 16, there is a grinding table 18 with an annular groove 20 on the upper surface. A set of three roller assemblies 50 (one shown) mate with an annular groove 20 in the upper surface of the grinding table 18. Each of the roller assemblies 50 rotates on the end of its own roller assembly shaft 52. Each roller assembly 50 has a plunger can structure 26 cooperatively associated with it. Each plunger can structure 26 houses several assemblies yet to be described which are operative to establish a mechanical spring suspension system working on the associated roller assembly 50. Each plunger can structure 26 is joined to a separate clamshell door 70 in the housing 12 to which its associated roller assembly 50 is joined.

Unpulverized coal up to about two inches in diameter is introduced into the pulverizer through a coal pipe 40 in the pulverizer upper portion. The coal falls downward onto the grinding table 18 and into the annular groove 20. The grinding table rotates so that the annular groove 20 passes under the roller assemblies 50. The roller assemblies 50 are biased towards the annular groove 20 by operation of the plunger can structures 26. The roller assemblies may be driven independently by suitable motors (not shown). The present invention would be equally applicable to a pulverizing mill in which the roller assemblies turn around a center housing and the grinding table is stationary.

A more detailed description of the nature of the construction and mode of operation of the pulverizing mill 10 is contained in the Guido and Prairie patents previously referenced.

Figure 2:
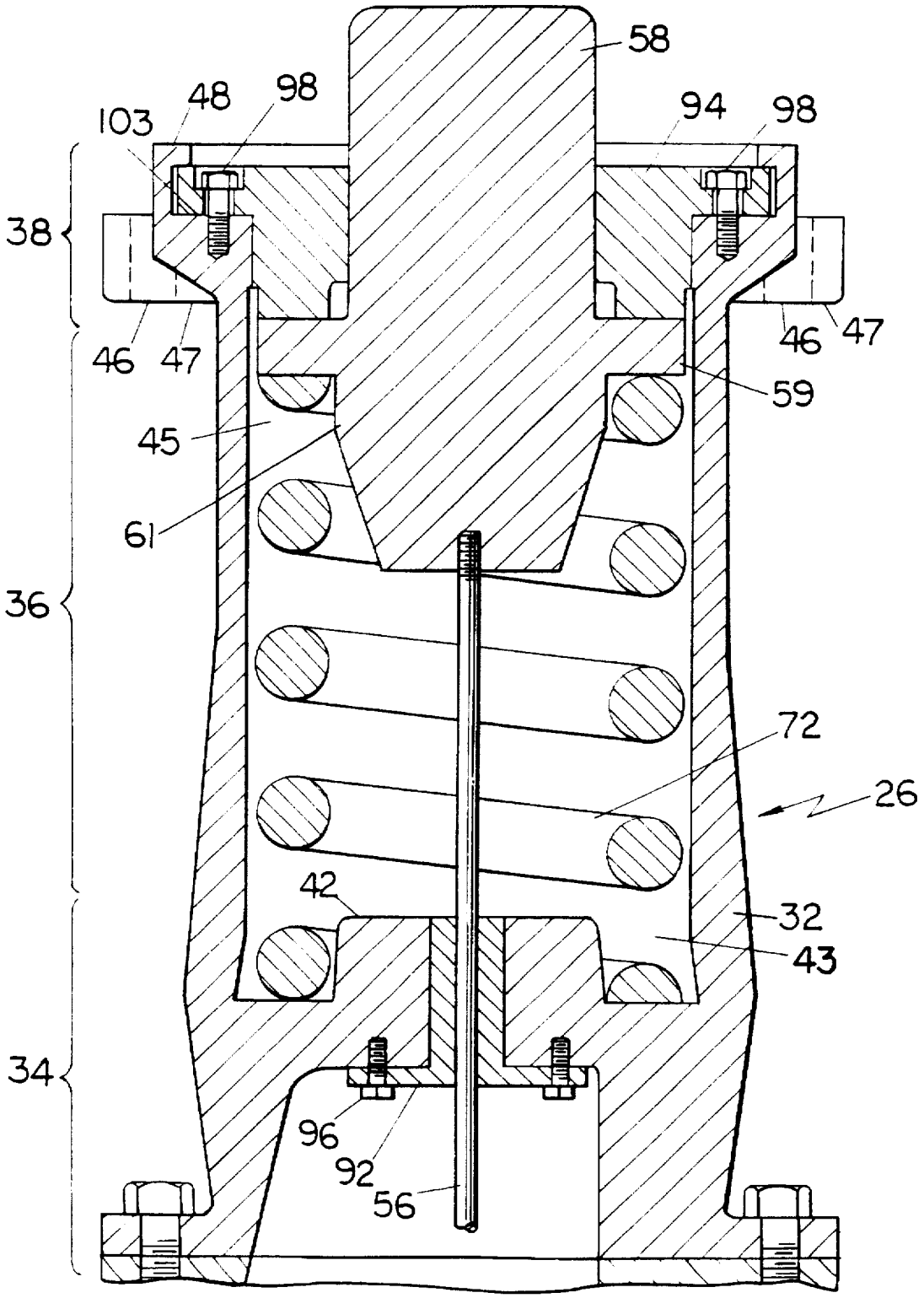
FIG. 2 shows a side sectional view of the plunger can structure of the invention.
Figure 3:
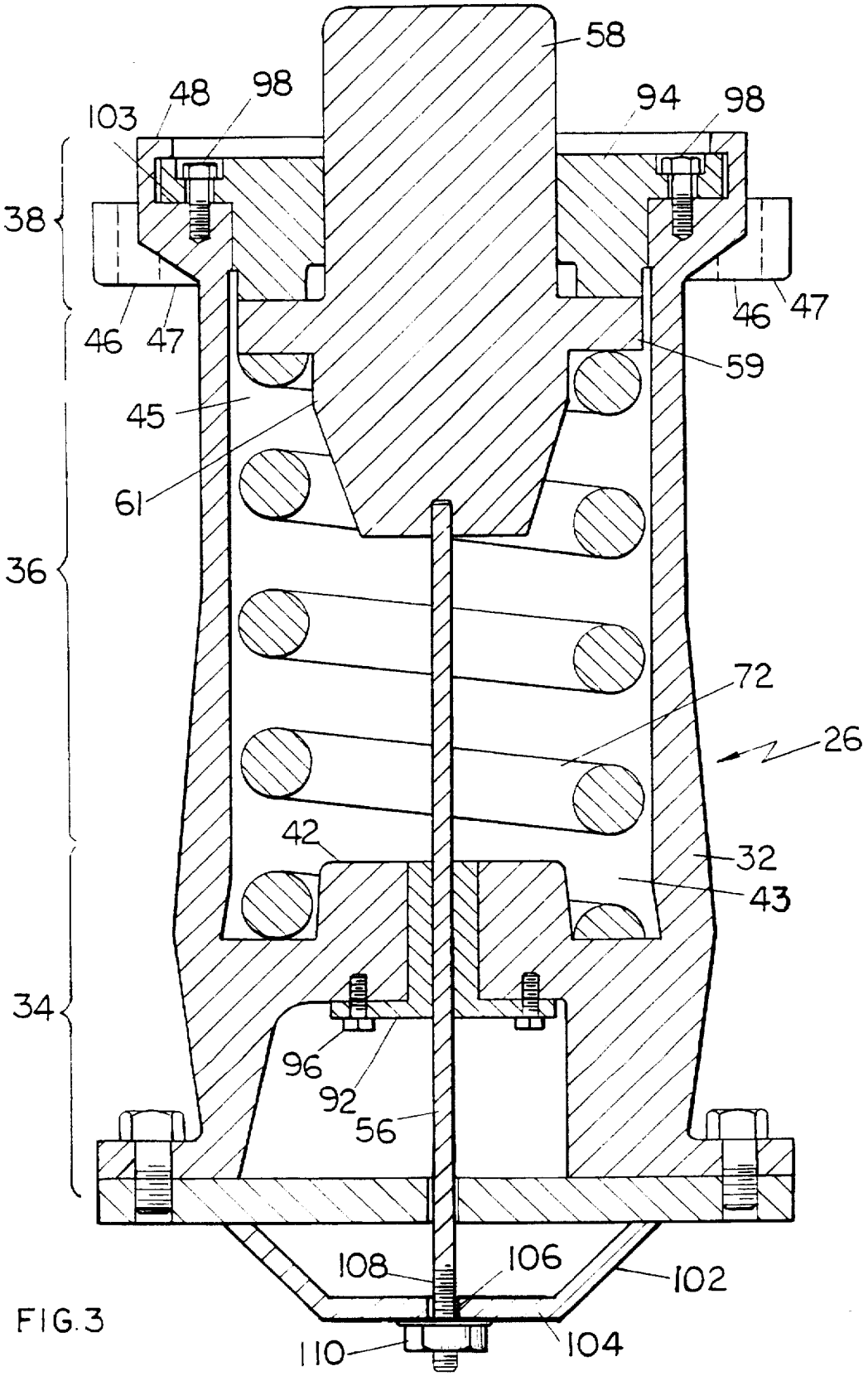
FIG. 3 shows the plunger can assembly of FIG. 2 with a shimming tool installed thereon to withdraw the plunger tip into the plunger can to shim the plunger tip.

FIGS. 2 and 3 illustrate the construction and use of the cast plunger can structure 26 and the assemblies housed therein. FIG. 2 shows a sectional side view of the plunger can structure 26 of the present invention. The plunger can structure 26 comprises a plunger can 32 which is preferably but not necessarily cast. The plunger can 32 houses the following major components: a compression spring 72, plunger guide 94 and a plunger tip 58.

The cast plunger can 32 and the various assemblies housed within the plunger can structure 26 first will be described with reference to FIG. 2. An indicator rod 56, preferably stainless steel, is threaded into one end of the plunger tip 58 so as to protrude out of the cast plunger can 32. The plunger tip 58 is mounted in one end of the plunger can 32 within the plunger guide 94 so that the plunger tip 58 protrudes out of the end of the plunger can 32. As shown in FIG. 1, a shim plate 60 may be attached in the conventional manner, by bolts, welding or otherwise, to the outer tip of the plunger tip 58. The shim plate abuts the roller assembly 50, to which it transfers the force of the compression spring 72 housed within the plunger can structure 26.

The plunger tip 58 includes an annular flange 59 on the end of the plunger tip 58 that is within the plunger can 32. The annular flange 59 serves as a stop to limit the extent to which the plunger tip 58 can extend out of the plunger guide 94. On the inner end of the plunger tip 58 is a hub 61 which snugly receives the compression spring 72.

The compression spring 72 housed within the plunger can structure 26 is designed to encircle the plunger tip hub 61 at one end and is itself encircled by and contained within the plunger can 32. A more detailed description of the cooperating cavities and regions of the cast plunger can 32 will be given in conjunction with the description of the cast plunger can below.

The indicator rod bearing 92 is itself encircled by the cast plunger can 32 to which it is attached by a set of bolts spaced equidistantly around the circumference of the cast plunger can 32, one of which bolts is shown at 96 in FIG. 2. The plunger guide 94 is likewise encircled by and attached to the cast plunger can 32. Because the plunger guide 94 serves not only as a bearing housing but also as an openable and interlocking safety cover to the cast plunger can 32, the plunger guide 94 is doubly affixed to the cast plunger can 32 by eight bolts spaced equidistantly around the circumference of said can, one of which bolts is shown at 98 in FIG. 2, and also by eight interlocking lugs spaced equidistantly around the circumference of said can, as described in U.S. Pat. No. 5,242,123 by Parham, the contents of which are hereby incorporated by reference.

Continuing to refer to FIG. 2, the plunger can 32 comprises the following regions: the can base region 34; the can neck region 36; and the can head region 38. The can base region 34 is thickened inward at the aperture to which the indicator rod bearing 92 is affixed to provide longitudinal support to the indicator rod, as it rides in reciprocating fashion through the indicator rod bearing 92. Said elongation is shown at 42 in FIG. 2. The can base region 34 includes, at the interior thereof, a cavity 43 formed by cooperation of (a) the base region thickening 42, as an inner annular wall, (b) the interior wall of the can base region 34 opposite said elongation, as an outer annular wall, and (c) the interior floor of said can base, as an annular seat. Said cavity is adapted to seat and hold in place the compression spring 72.

The interior wall of the can head region 38, in cooperation with the shoulder formed by the plunger tip hub 59, forms an annular mount 45 adapted to seat and hold in place the other end of the compression spring 74.

The cast plunger can 32 is fabricated from a single casting of steel in accordance with processes known in the art to achieve a unitary structure having a tensile strength around 120,000 PSI. This is a more than three-fold improvement in strength compared to about 35,000 PSI tensile strength of existing fabricated cans. The embodiment of the cast plunger can 32 shown in FIG. 2 shows a thickening about the can base region 34 where the structure is increased in bulk so as to withstand anticipated wear. Variable and uneven wear on any plunger can mounted in a pulverizing mill is expected due to the sand blasting effect of pulverized coal dust particles suspended in the high velocity air flow throughout the mill (accounting for wear), combined with the unique air flow patterns characteristic of every different mill (accounting for the variability of the wear from mill to mill, and for the unevenness of wear along the length of a plunger can within any one mill). Since said uneven wear is frequently found to result in greater wear on the portion of the plunger can structure 26 at or near the point of its attachment to the clamshell door 70 of the pulverizing mill 10 (FIG. 1), the embodiment of the cast plunger can 32 shown in FIG. 2 demonstrates a counterbalancing thickening at the can base region 34 thereof so as further to improve the durability of said cast plunger can. The cast plunger can 32 of the present invention may be variably thickened, not only at the can base region 34 as shown, but also at the can neck region 36, or the can head region 38, or any combination of said regions.

Referring to FIG. 2, the plunger can structure 26 is loaded with the compression spring 72. The plunger tip 58 and indicator rod 56 are then loaded into the plunger can structure 26 so as to be encircled by the compression spring 72. The indicator rod bushing 92 is affixed to the cast plunger can 32 so as to provide a journal bearing surface for the indicator rod 56. Said indicator rod bushing is shown with its bolted surface approaching the cast plunger can 32 from the exterior thereof, but may also be affixed from the opposite direction so that its bolted surface would approach said can from the interior thereof. Finally, the plunger guide 94 is placed suitably into position on top of and encircling the plunger tip 58 and so aligned with the can lug gaps of the cast plunger can 32 as to rest in the lip 48 of said can. The loading of the plunger can structure 26 is completed by operation of a spring compressor assembly which is now temporarily attached to mating lugs of the cast plunger can 32 by support studs of said compressor assembly and secured in place by stud nuts, all as described in some detail in above-referenced U.S. Pat. No. 5,242,123. Appropriate rotation of the lug nut of the ball shaft of the spring compressor assembly 112 causes the plunger tip 58 to be pushed into the cast plunger can 32, thereby compressing the compression spring 72 and releasing the plunger guide 94 from the force otherwise applied against it by the action of said spring on the plunger tip 58. With the spring force thereby released, the plunger guide 94 is rotated into place within the cast plunger can 32, using the vertical lugs supplied on the top of said plunger guide 94 or by using a wrench designed for that purpose. After the plunger guide 94 is doubly secured in place (by cooperation of the can lugs 50 and cover lugs 100 previously discussed, and by the bolts 98 previously discussed), the spring compressor assembly may be safely detached from the plunger can structure 26.

As mentioned, the plunger can structure 26 includes an indicator rod 56 which protrudes through the clamshell door 70 and is cooperatively associated with a diaphragm seal at the point of protrusion. Diaphragm seals are well known, and generally include a mounting plate, a seal retaining ring, a seal inner collar, and a seal outer collar ring, all of which are interengaged through the use of any suitable form of conventional fastening means. The indicator rod 56 provides an immediate visual indication of the actual travel of the plunger assembly within the plunger can structure 26. As said plunger assembly rides in reciprocating motion within said can structure 26, the indicator rod 56 affords an easy and direct reading of the plunger action otherwise contained within structures not open to view during ordinary operation. It should be noted that the indicator rod 56 is a detachable member, best suited for use in a pulverizing mill 10 (FIG. 1) in which the roller assemblies 50 and associated plunger can assemblies 26 are stationery and in which the grinding table 18 rotates.

An important aspect of the use of the plunger can structure 26 of the present invention has to do with the shim plate 60 (see FIG. 1) which is disposed between the plunger tip 58 and the roller assembly 50 to thereby adjust the force exerted by the plunger can structure 26 on the roller assembly 50. Typically, the compression tension is set, within the appropriate tolerances, by the mill operator specifying the desired tension to the supplier of the compression spring 72 who then furnishes the appropriate spring. However, some adjustment to the preloaded tension is, from time to time, desirable to compensate for wear in the rollers. In the preferred embodiment of the present invention, such adjustment is effected by replacement of the shim plate 60 with a thinner or thicker plate. A thinner shim plate 60 reduces the compression applied to the roller assembly 22, while a thicker shim plate 60 has the opposite effect.

In the prior art systems, replacement of the shim plate 60 requires opening the clamshell doors to relieve the force between the roller assembly 50 and the plunger can structure 26, so that a clearance is produced therebetween to allow the removal and replacement procedure to be performed. A novel feature of the present invention is that this removal and replacement procedure can be performed without opening the clamshell doors, as follows. An indicator rod puller tool 102 is mounted to the exterior of the plunger can structure 26 (or the exterior of the clamshell door to which the plunger can structure 26 is attached) as shown in FIG. 3. The indicator rod puller 102 includes a base plate 104 having a hole 106 therethrough to receive the end of the indicator rod 56. The end of the indicator rod 56 is preferably threaded with threads 108 which mate with a nut 110.

The indicator rod puller 102 is mounted to the clamshell door so that the indicator rod 56 extends through the hole 106. The nut 110 is threaded onto the threads 108 of the end of the indicator rod 56 and tightened against the base plate 104. Continued tightening of the nut 110 draws the indicator rod 56 out of the plunger can structure 26. This draws the plunger tip 58 to which the other end of the indicator rod is attached into the plunger can structure 26 and away from the roller assembly 50. This produces a clearance between the plunger tip 58 and the roller assembly 50 which allows the removal and replacement of the shim 60. It can be appreciated that the indicator rod puller 102 shown in FIG. 3 and described above is only illustrative, and that alternate tools may be used instead; the important point is that a pulling force is exerted to draw the plunger tip 58 into the plunger can structure 26.

What is claimed is:

1. A method for adjusting the force exerted by a plunger assembly on an engaged pulverizing mill roller assembly, the plunger assembly including a hollow housing having an open end, a plunger tip mounted to the housing to close the open end, a plunger tip reciprocally mounted in the housing having one end bearing against the housing and an opposite end bearing against the plunger tip, and a rod extending through the housing having one end attached to the plunger tip and an opposite end extending out of the housing, the method comprising: grasping said opposite end of the rod with a grasping tool; urging the rod out of the housing to thereby compress the compression spring and urge the plunger tip into the housing to open a space between the plunger tip and the roller assembly; shimming said space; and releasing said opposite end of the rod to allow the compression spring to uncompress and the plunger tip to bear against the roller assembly.

2. The method of claim 1, wherein said grasping and urging steps include placing a rod-pulling tool onto the plunger assembly, the rod-pulling tool having a base plate to mount on the plunger assembly and a hole through the base plate to receive said opposite end of the rod, the opposite end of the rod being threaded; and threading a nut onto said opposite end of the rod and against the base plate to draw the rod partially through the hole.

* * * * *